US008268114B2

(12) United States Patent
Masumura et al.

(10) Patent No.: US 8,268,114 B2
(45) Date of Patent: Sep. 18, 2012

(54) WORKPIECE HOLDER FOR POLISHING, WORKPIECE POLISHING APPARATUS AND POLISHING METHOD

(75) Inventors: Hisashi Masumura, Fukushima (JP); Fumio Suzuki, Fukushima (JP); Kouji Kitagawa, Fukushima (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 616 days.

(21) Appl. No.: 10/490,480

(22) PCT Filed: Sep. 27, 2002

(86) PCT No.: PCT/JP02/10063

§ 371 (c)(1),
(2), (4) Date: Mar. 23, 2004

(87) PCT Pub. No.: WO03/030232

PCT Pub. Date: Apr. 10, 2003

(65) Prior Publication Data

US 2004/0238121 A1 Dec. 2, 2004

(30) Foreign Application Priority Data

Sep. 28, 2001 (JP) ..... 2001-301179
Sep. 28, 2001 (JP) ..... 2001-302859

(51) Int. Cl.
*H01L 21/68* (2006.01)
*H01L 21/304* (2006.01)
*B24B 37/04* (2006.01)

(52) U.S. Cl. ..... 156/345.12; 451/288; 451/388; 451/398; 451/289

(58) Field of Classification Search ..... 118/500, 118/728; 156/345.51, 345.12; 269/21; 451/53, 451/288, 388, 398, 289
See application file for complete search history.

(56) References Cited

U.S. PATENT DOCUMENTS 5,101,602 A * 4/1992 Hashimoto ..... 451/390
5,180,000 A * 1/1993 Wagner et al. ..... 165/80.1
5,335,457 A * 8/1994 Matsuda et al. ..... 451/284
5,578,362 A * 11/1996 Reinhardt et al. ..... 428/147
5,645,736 A * 7/1997 Allman ..... 216/89
5,895,509 A * 4/1999 Ohmi et al. ..... 51/307
5,923,408 A * 7/1999 Takabayashi ..... 355/53
5,964,646 A * 10/1999 Kassir et al. ..... 451/41
5,976,000 A * 11/1999 Hudson ..... 451/534

(Continued)

FOREIGN PATENT DOCUMENTS

EP 0 454 362 A2 10/1991

(Continued)

OTHER PUBLICATIONS

Table of Coefficient of Thermal Expansion. Epoxy Resin. Taken from www.ami.ac.uk/courses.Published Jan. 1997.*

(Continued)

*Primary Examiner* — Sylvia R. MacArthur
(74) *Attorney, Agent, or Firm* — Oliff & Berridge, PLC

(57) ABSTRACT

A workpiece holder for polishing includes a workpiece holder body having multiple perforated holes to hold a workpiece by vacuum suction. A holding surface of the workpiece holder body may be coated with resin. A coefficient of thermal expansion of the resin coating on the holding surface may be $1\times10^{-5}$/K or less. The resin coating on the holding surface may be epoxy resin filled with silica particles.

8 Claims, 8 Drawing Sheets

U.S. PATENT DOCUMENTS

| | | | | |
|---|---|---|---|---|
| 6,024,631 | A * | 2/2000 | Piper | 451/41 |
| 6,210,260 | B1 * | 4/2001 | Tanaka et al. | 451/289 |
| 6,358,129 | B2 * | 3/2002 | Dow | 451/285 |
| 6,386,957 | B1 * | 5/2002 | Masumura et al. | 451/59 |
| 6,422,922 | B1 * | 7/2002 | Okamura et al. | 451/41 |
| 6,475,068 | B1 | 11/2002 | Jimbo et al. | |
| 6,495,464 | B1 * | 12/2002 | Boyd et al. | 438/690 |
| 6,527,627 | B2 * | 3/2003 | Arai | 451/41 |
| 6,541,989 | B1 * | 4/2003 | Norris et al. | 324/755 |
| 6,592,671 | B2 * | 7/2003 | Sun et al. | 118/625 |
| 6,597,432 | B2 * | 7/2003 | Ida | 355/73 |
| 6,685,539 | B1 * | 2/2004 | Enomoto et al. | 451/41 |
| 6,752,703 | B2 * | 6/2004 | Boyd et al. | 451/289 |
| 6,769,966 | B2 * | 8/2004 | Okamura et al. | 451/53 |
| 6,890,244 | B2 * | 5/2005 | Hsu et al. | 451/41 |
| 2001/0018322 | A1 * | 8/2001 | Dow | 451/287 |
| 2003/0008604 | A1 * | 1/2003 | Boo et al. | 451/388 |
| 2003/0101658 | A1 * | 6/2003 | Ohno et al. | 51/308 |
| 2004/0238121 | A1 * | 12/2004 | Masumura et al. | 156/345.12 |
| 2004/0248415 | A1 * | 12/2004 | Wada et al. | 438/690 |

FOREIGN PATENT DOCUMENTS

| | | | |
|---|---|---|---|
| EP | 1 046 462 | A2 | 10/2000 |
| JP | 04284648 | A * | 10/1992 |
| JP | A-06-077187 | | 3/1994 |
| JP | A-08-124756 | | 5/1996 |
| JP | A-08-267499 | | 10/1996 |
| JP | A-09-234740 | | 9/1997 |
| JP | A-10-012712 | | 1/1998 |
| JP | A-11-233604 | | 8/1999 |
| JP | A-2000-015573 | | 1/2000 |
| JP | A-2000-198069 | | 7/2000 |
| JP | A-2000-271863 | | 10/2000 |
| JP | A 2000-315665 | | 11/2000 |
| JP | A-2001-198801 | | 7/2001 |
| JP | A 2001-198809 | | 7/2001 |
| JP | A-2001-217511 | | 8/2001 |
| JP | A-2001-238384 | | 8/2001 |
| JP | A 2001-239451 | | 9/2001 |

OTHER PUBLICATIONS

Hawley's Condensed Chemical Dictionary. Epoxy Resin.2002.John Wiley & Sons, 14 Edition.*

* cited by examiner

WORKPIECE HOLDER FOR POLISHING, WORKPIECE POLISHING APPARATUS AND POLISHING METHOD

TECHNICAL FIELD

The present invention relates to a workpiece holder, a workpiece polishing apparatus using this workpiece holder, and a polishing method, which can effectively prevent the generation of unevenness on a nanotopography level.

BACKGROUND ART

Conventionally, a production method of a workpiece such as a silicon wafer used as a semiconductor substrate material is generally performed through a crystal growth process in which a single crystal ingot is produced by Czochralski (CZ) method, Floating Zone (FZ) method or the like, and a wafer manufacturing process in which the single crystal ingot is sliced into a wafer and at least one main surface of the wafer is mirror-polished.

Describing the wafer manufacturing process in more detail, the wafer manufacturing process comprises a slicing process for slicing a single crystal ingot to obtain a thin disk wafer, a chamfering process for chamfering a peripheral portion of the wafer obtained in the slicing process to prevent breakage or cracking of the wafer, a lapping process for flattening the wafer, an etching process for removing mechanical damage remaining on the wafer subjected to chamfering and lapping, a polishing process for mirror-polishing a surface of the wafer, and a cleaning process for cleaning the polished wafer to remove polishing agent or dust particles adhered on the wafer.

Main processes are shown in the above wafer manufacturing processes, and there may be the cases that other processes such as a heat treatment process are added therein, the same process is performed in multiple steps, and the order of processes is changed.

Among these processes, a single side polishing apparatus of the wax mount batch type in which plural wafers are adhered to a plate made of glass, ceramic or the like with wax and each one side of the wafers is polished is mainly used in the polishing process at present. In this apparatus, the plate in which wafers are held is placed on a turntable in which a polishing pad is attached, a load is applied to an upper top ring, and the polishing is performed as the turntable and the top ring are rotated. There are several forms of polishing apparatuses in addition to this. There are several types of the polishing, for example, a double-side polishing type that both sides of wafers are mirror-polished simultaneously by holding wafers between upper and lower turn tables, a single wafer processing type that wafers are polished one by one while holding it on a plate by vacuum suction, and a wax-free polishing type that wafers are polished while holding them with a backing pad and a template without using an adhesive such as wax.

In particular, recently, in accordance with the increase in diameter of a wafer (workpiece), a single wafer processing type apparatus that wafers are polished one by one while holding it on a wafer holder (plate) by vacuum suction has been used.

In the case that the polishing was performed with the above-described single wafer processing type apparatus by holding a wafer by vacuum suction, there are some cases that extremely small unevenness is observed on a wafer surface. In particular, it is numerously observed around parts of a wafer surface corresponding to where suction holes exist. This unevenness can be observed on a level in the case of the observation by a magic mirror image or evaluation of unevenness in a micro area referred as nanotopography.

In particular, it is often observed when polishing is performed with a workpiece holder of which the holding surface is coated with epoxy resin or the like, or performed by adhering a workpiece on a plate with wax or the like.

Also, in the case that a workpiece is held with a backing pad and a template, there may be the case that under the influence of the uneven thickness of the backing pad and the uneven thickness of adhesive generated when a backing pad itself is adhered to a workpiece holder, those are transferred to a surface of the wafer after polishing.

The nanotopography (may be called as nanotopology) is unevenness of which wavelength is about 0.1-20 mm and amplitude is about from several nanometers to one hundred nanometers, and as an evaluation method thereof, vertical interval of the unevenness on a wafer surface (P-V value; peak to valley) is evaluated in a region called a block area of a square about from 0.1 to 10 mm on a side or a circle having a diameter of about from 0.1 to 10 mm (this area is called WINDOW SIZE, or the like).

This P-V value is also called Nanotopography Height, or the like.

As to the nanotopography, in particular, it is desirable that the maximum value of unevenness on a surface of a wafer evaluated is small.

When processes that metal patterns are formed on a wafer, an insulator film is formed thereon, the insulator film is polished, and so on are repeated in the device fabricating process, the existence of the unevenness on the above level has come to a problem. In particular, in a high-integrated device process, the unevenness causes defocus failure in lithography exposure, and thus it makes the decrease of yield of high-integrated devices, which came to a problem.

DISCLOSURE OF THE INVENTION

The present invention was accomplished in view of the aforementioned circumstances, and its object is to provide a polishing apparatus and a polishing method, in particular, a workpiece holder to polish a wafer so as not to generate unevenness on a nanotopography level.

The workpiece holder of the present invention is characterized by comprising a workpiece holder body for holding one main surface of a workpiece and mirror-polishing the other main surface thereof, wherein micro pores are formed on a workpiece holding surface of the workpiece holder.

It became clear that when a wafer is held on the workpiece holding surface of the workpiece holder, its nanotopography is degraded due to generation of dust particles, water, or air traps. In particular, the degradation remarkably occurs in the case that a holding surface of the workpiece holder is coated with resin such as epoxy resin.

Conventionally, there has been a problem that unevenness of both a back surface of the wafer and the workpiece holding surface of the workpiece holder are transferred to a polished surface of the wafer, and therefore it has been performed that the back surface of the wafer and the workpiece holding surface of the workpiece holder are smoothed by polishing or the like so as to make them much flat or make them fit to the shape of a polishing pad.

As a result, dust particles, water, or air traps easily generate, and the nanotopography is degraded at that positions.

Accordingly, by forming micro pores on a holding surface of the workpiece holder, it becomes difficult to generate dust particles, water, or air traps existing between the back side of the wafer and the holding surface of the workpiece holder, and therefore, the degradation of the nanotopography is not observed.

Specifically, the workpiece holder wherein micro pores are formed on a workpiece holding surface thereof is obtained by coating it with an inorganic or organic coating agent to which particles dissoluble in a dissolving agent such as water or a solvent are added, and dissolving a surface of the coating agent layer with a dissolving agent such as water or a solvent.

It is preferable that pores are formed on a surface of the coating agent layer of the workpiece holder body as described above.

The surface of the coating agent layer on which pores are formed can be a workpiece holding surface.

As to the particles dissoluble in a dissolving agent such as water or a solvent as aforementioned, it is preferable that EDTA (ethylene diamine tetra-acetic acid) particles, water-soluble cellulose particles or the like are used.

As described above, by using the particles dissoluble in a dissolving agent such as water or a solvent, it is possible to easily form pores having any sizes by controlling diameters of particles to be added.

By the way, if diameters of pores are increased, shapes of the pores are transferred to a wafer surface, and therefore, it is preferable that diameters of pores are 0.5 mm or less.

In addition, the lower limit of diameter of pores is preferably 0.02 mm or more.

In particular, it is further preferable that diameters of pores are several dozens of micrometers or more.

As to the other example of the formation method of pores on the workpiece holding surface of the workpiece holder, it is also possible that hollow particles formed out of the material possible to be removed by polishing are added to the aforementioned coating agent, the surface of the workpiece holder body is subjected to coating, and the surface of the coating agent layer is polished so that shells of the hollow particles are eliminated and thus pores are formed on the surface of the coating agent layer.

In this case as well, the surface of the coating agent layer on which pores are formed is preferably used as the workpiece holding surface.

And, if particles are dissoluble in a polishing agent, particles existing in the surface portion of the coating agent layer are removed in dissolution by polishing, and pores can be formed.

Accordingly, as to particles, it is not necessary to particularly limit the particles to hollow particles.

Also, as to the hollow particles, it is preferable that silica balloons which can be polished by common polishing agent containing silica are used.

The silica balloons are silica particles, which are spherical silica particles and whose insides are hollow (only shells).

Thus, the hollow particles are added to the aforementioned coating agent, the surface of the workpiece holder body is coated with the coating agent, the surface of the coating agent layer is polished to remove parts of shells of the hollow particles, and thereby, pores can be easily formed on the workpiece holding surface of the workpiece holder.

As to the one of the other aspects of the workpiece holder of the present invention, the workpiece holder wherein a resin film to which particles dissoluble in a dissolving agent such as water or a solvent are added is adhered to the workpiece holding surface can be preferably used.

As described above, particles dissoluble in a dissolving agent such as water or a solvent, or hollow particles are added to resin coating a surface of the workpiece holder body or a resin film adhered to the workpiece holding surface, polishing is performed to form a coating agent layer surface or a resin film surface having micro pores, and thus the surface having the micro pores is used as the workpiece holding surface.

The micro pores mean dimples having diameters of about 0.5 mm or less formed on a wafer holding surface.

As to the workpiece holder of the present invention, in the case that a surface of the workpiece holder body is coated with a coating agent to which particles dissoluble in a dissolving agent such as water or a solvent are added, only particles existing on the surface portion of the coating agent layer are removed in dissolution to form pores on the surface of the coating agent layer, and the surface of the coating agent layer in which pores are formed is used as a workpiece holding surface, it is possible to form pores only on the surface portion of the coating agent layer, i.e., only on the workpiece holding surface without degradation of flatness of the surface of the workpiece holder body flattened by machining or the like.

Further, in the case that the surface of the workpiece holder body is coated with the coating agent to which particles dissoluble in a polishing agent or hollow particles possible to be removed by polishing are added, and the surface of the coating agent layer is subjected to a polishing process, particles existing in the surface portion of the coating agent layer are dissolved, so that pores are naturally formed, and thus it is possible to form micro pores on the surface of the coating agent layer, i.e., on the workpiece holding surface of the workpiece holder without degradation of flatness of the surface of the workpiece holder body.

If the workpiece holder is produced by such a method, pores existing on the holding surface can be preferably formed in preferable size, depth and in-plane distribution.

A workpiece polishing apparatus of the present invention is characterized by comprising the above workpiece holder of the present invention.

A polishing method of the present invention is characterized in that one main surface of a workpiece is held and the other main surface of the workpiece is mirror-polished, and the workpiece is held and polished in a state that micro pores are formed on a workpiece holding surface of the workpiece holder.

In particular, it is preferable that the workpiece holder and the polishing apparatus described above are used.

Further, the present invention for solving the above problems is a workpiece holder for polishing wherein the workpiece holder for polishing comprises a workpiece holder body having multiple perforated holes to hold a workpiece by vacuum suction, a holding surface of the workpiece holder body is coated with resin, and a coefficient of thermal expansion of the resin coating the holding surface is $3\times10^{-5}$/K or less.

In such a workpiece holder for polishing of which holding surface is coated with low thermal expansion resin whose coefficient of thermal expansion is $3\times10^{-5}$/K or less, since a quantity of thermal deformation of the holding surface during polishing is extremely small, a wafer of which nanotopography is improved can be produced. Namely, if the coefficient of thermal expansion of the resin is $3\times10^{-5}$/K or less, deformation of suction holes which have an influence on unevenness of the nanotopography hardly occurs. Further it is preferable that the coefficient of thermal expansion of the resin is less than $3\times10^{-5}$/K, and it is almost the same as that of the workpiece holder body as much as possible.

In this case, it is preferable that thermal conductivity of the resin coating the holding surface is 0.4 W/mK or more.

As described above, if the thermal conductivity of the resin coating the holding surface is 0.4 W/mK or more, heat which generates during polishing is made uniform in the resin, and can be radiated effectively, and thereby, the degradation of the nanotopography due to the thermal deformation can be prevented effectively. Therefore, the upper limit of the thermal conductivity of the resin is not limited in particular. Although the upper limit of the thermal conductivity is determined by a material of the resin, additives added thereto, the amount of additives (the possible amount of additives), and the like, it is preferable that the temperature difference between the front and the back side of the resin coating layer is difficult to generate as the thermal conductivity is higher, and therefore, the thermal deformation of the resin layer can be inhibited. If the thermal conductivity of the resin is 0.4 W/mK or more, deformation of suction holes, which has an influence on unevenness of the nanotopography, hardly occurs.

In addition, the thermal conductivity of the resin as in the present invention is the value evaluated by a method based on JIS R1611.

In this case, it is preferable that the resin coating the holding surface is epoxy resin filled with silica particles.

As described above, if the resin coating the holding surface is epoxy resin filled with silica particles as thermal conductivity adjusters, it is preferable that the coefficient of thermal expansion of the holding surface becomes small and the thermal conductivity thereof is increased. In particular, since silica particles can be filled into the epoxy resin in larger amount than calcium carbonate particles which were conventionally filled into epoxy resin for coating the holding surface (a limit of the filling amount is about 50% by weight) and the coefficient of thermal expansion of silica is also very small, it is preferable that the coefficient of thermal expansion of the holding surface can be further decreased.

In this case, it is preferable that the silica particles filled into the epoxy resin are 60% by weight or more of the epoxy resin.

As described above, if the silica particles filled into-the epoxy resin are 60% by weight or more of the epoxy resin, the coefficient of thermal expansion becomes sufficiently small and the thermal conductivity is increased, and therefore, it is preferable that the coefficient of thermal expansion of the resin surely becomes $3\times10^{-5}$/K or less and the thermal conductivity of the resin surely becomes 0.4 W/mK or more.

In this case, it is preferable that the silica particles filled into the epoxy resin are granulated particles having diameters of 1-10 μm.

In the case of silica particles having diameters of less than 1 μm, the viscosity of the resin into which the silica particles are filled is increased, and thus many silica particles can not be filled into the resin. Also, in the case of large silica particles having diameters of more than 10 μm, unevenness of the surface of the resin coating the holding surface is increased, and if a wafer is held on the surface thereof, there is the possibility that its nanotopography is degraded. Therefore, it is preferable that silica particles filled into the resin are granulated particles having diameters of about 1-10 μm. Moreover, in the case of filling almost spherical large silica particles having diameters of about 10 μm and almost spherical small silica particles having diameters of about 1-3 μm, it is possible that the amount of the filled particles is further increased, and the coefficient of thermal expansion can be further decreased and the thermal conductivity can be further increased.

And as to the workpiece polishing apparatus of the present invention comprising a workpiece holder for polishing, since thermal deformation is difficult to occur in a resin layer of a surface of the workpiece holder for polishing, the nanotopography of the workpiece to be polished can be improved. In particular, in the case that a silicon wafer is polished as a workpiece, defocus failure in lithography exposure can be lowered in a high-integrated device fabrication process, and yield of high-integrated devices can be improved.

And the present invention relates to a workpiece polishing method wherein a holding surface of a workpiece holder for polishing to hold a workpiece by vacuum suction is coated with resin of which coefficient of thermal expansion is $3\times10^{-5}$/K or less, a back surface of the workpiece is held on the holding surface by vacuum suction, and the workpiece is brought into close contact with a polishing pad to polish a front surface of the workpiece.

As described above, since the holding surface of the workpiece holder for polishing is coated with the resin of which coefficient of thermal expansion is $3\times10^{-5}$/K or less, the quantity of thermal deformation can be decreased and the polishing can be performed so that nanotopography is improved thereby.

In this case, it is preferable that a thermal conductivity of the resin coating the holding surface is 0.4 W/mK or more.

As described above, if the thermal conductivity of the resin coating the holding surface is 0.4 W/mK or more, heat which generates during polishing can be made uniform in the resin and heat is transferred and radiated efficiently, and thereby, an abnormality due to thermal deformation can be further prevented and a wafer of which nanotopography is improved can be produced.

In this case, it is preferable that before the back surface of the workpiece is held by vacuum suction, the holding surface of the workpiece holder for polishing coated with the resin is brought into close contact with the polishing pad and polished, and after that, a back surface of the workpiece is held on the holding surface by vacuum suction, and then the workpiece is brought into close contact with the polishing pad to polish the front surface of the workpiece.

As described above, since before the back surface of the workpiece is held by vacuum suction, the holding surface of the workpiece holder for polishing coated with the resin is brought into close contact with the polishing pad and polished so that the shape of the holding surface becomes the same as that of the polishing pad, deviation of flatness of the workpiece due to the influence of deformation during polishing by the polishing pad can be adjusted, in particular, it is effective to improve flatness of a thin workpiece such as a wafer.

Explaining the typical effect accomplished by the present invention, first, there is provided a workpiece holder for polishing by which it is possible to obtain a workpiece having a high precision surface.

Therefore, a workpiece of which surface has an excellent flatness and no waviness can be produced by polishing using this.

In particular, unevenness on a nanotopography level can be improved, and in the case of a semiconductor wafer polished by using the workpiece holder for polishing of the present invention, defocus failure in lithography exposure can be reduced in a high integrated device fabrication process, and the yield of high integrated devices can be improved.

BEST MODE FOR CARRYING OUT THE INVENTION

Figure 1:
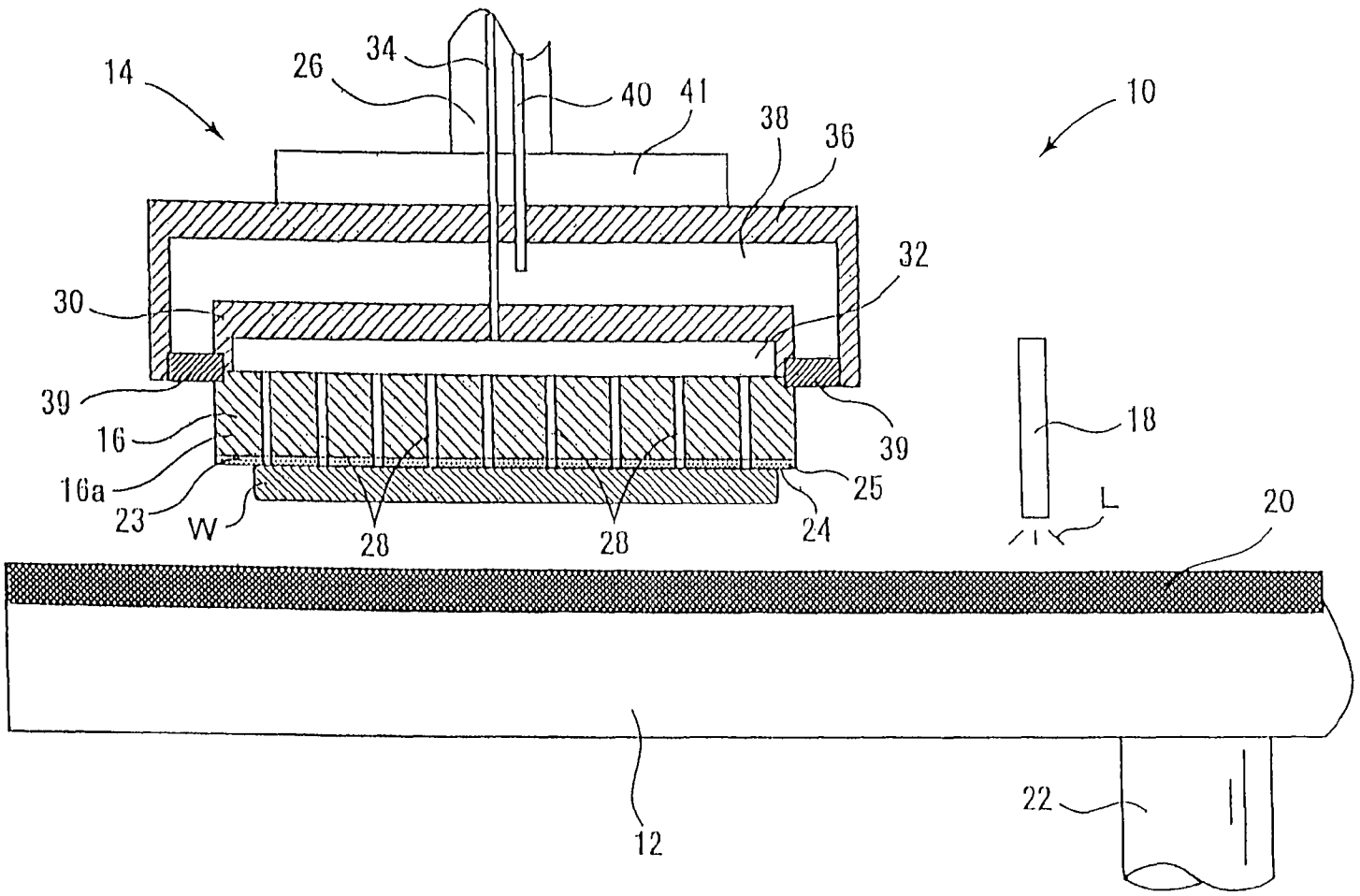
FIG. 1 is a schematic cross-sectional view illustrating an embodiment of a polishing apparatus according to the present invention.

Hereafter, embodiment of the present invention will be explained in detail in reference to appended drawings. However, it goes without saying that various modifications or changes are possible in addition to the examples shown in the drawings as long as they do not depart from technical ideas of the present invention.

A basic shape of the polishing apparatus to which the technical ideas of the present invention is applied is not limited, in particular. In the following examples shown in drawings described hereinafter, there will be explained the case that the technical ideas of the present invention are applied to a single wafer processing type polishing apparatus in which a single wafer is held on a wafer holder by vacuum suction and polished.

FIG. 1 is a schematic cross-sectional view for explaining the general structure of the polishing apparatus according to the present invention comprising a polishing head on which the workpiece holder according to the present invention is mounted.

As shown in FIG. 1, a polishing apparatus 10 of the present invention is constituted as an apparatus for polishing one surface of a workpiece W such as a semiconductor wafer, and the polishing apparatus 10 comprises a rotating polishing turntable (rotating table) 12, a workpiece holder for polishing 16 mounted on a polishing head 14, and a polishing agent feeding nozzle 18.

A polishing pad 20 is adhered to the upper surface of the polishing turntable 12.

The polishing turntable 12 is rotated at a predetermined rotation speed by a rotating shaft 22.

The workpiece holder 16 holds a workpiece (wafer) W on a workpiece holding surface 24 thereof by vacuum suction or the like, it is mounted on the polishing head 14 having a rotation shaft 26, and it presses the workpiece W against the polishing pad 20 at a predetermined load at the same time it is rotated by the polishing head 14.

A polishing agent L is fed from the polishing agent feeding nozzle 18 onto the polishing pad 20 at a predetermined flow rate, and by feeding the polishing agent L between the workpiece W and the polishing pad 20, the workpiece W is polished.

Further, as shown in FIG. 1, the workpiece holder 16 for polishing of the present invention is constituted of the workpiece holding surface 24, a workpiece holder body 16*a* having multiple perforated holes 28 for vacuum suction, and a workpiece holder back plate 30.

The perforated holes 28 communicates with a vacuum apparatus (not shown) via a space 32 located between the workpiece holder body 16*a* and the workpiece holder back plate 30 through a vacuum way 34, and the workpiece W is held by suction on the workpiece holding surface 24 due to generation of vacuum.

In particular, a surface 23 of the workpiece holder body 16*a* is coated with a coating agent layer, such as a resin layer 25 having perforated holes 28.

This is because scratches or stains are occurred on the back surface of the workpiece W if the workpiece W is directly held on the surface of the workpiece holder body 16*a* made of metal, ceramics or the like. In order to prevent this, the surface 23 of the workpiece holder body 16*a* is coated with an extremely thin resin layer having a thickness from several micrometers to several millimeters as the resin layer 25, which is made of material known for Teflon, Nylon etc. as brand names, polyvinyl chloride resin, or the like, or an acrylic resin plate having holes for vacuum suction is adhered to the surface 23 of the workpiece holder body 16*a*, and the surface thereof is polished to serve as a surface of a suction plate has been used as the workpiece holding surface 24.

As to a material used as the resin layer 25 coating the surface 23 of the workpiece holder body 16*a*, epoxy resin which is a thermosetting resin is particularly useful in terms of easy coating, and qualities such as hardness, mechanical strength and a coefficient of linear thermal expansion which are properties of the coating after heat curing.

In the case of polishing, since a soft polishing pad is used, there is a problem that even if the surface 23 of the workpiece holder body 16*a* is flattened, the surface of the polishing pad 20 is gradually deformed due to creep deformation or the like of the polishing pad 20, and thus, a workpiece after polishing does not necessarily become flat.

Therefore, there is another method that after the surface 23 of the workpiece holder body 16*a* is coated with a thin resin layer, the surface 23 of the workpiece holder body 16*a* is polished, and thereby, the workpiece holder body 16*a* is made so that its surface fits the shape of creep deformation of the polishing pad 20, and then, the workpiece W is polished.

The polishing head 14 has a pressurized space 38 inside its outer cover (rotating holder) 36, and it holds the workpiece holder 16 air-tightly via an elastomer ring 39. The pressurized space 38 communicates with an air compressor (not shown) via a pressurization way 40.

And the workpiece holder 16 in which the workpiece W is held on the workpiece holding surface 24, i.e., the surface of the resin layer 25 by vacuum suction is rotated or swung, and at the same time, the back surface of the workpiece holder 16 is pressurized with air so that the workpiece holder 16 is pressed against the polishing pad 20.

In addition, in FIG. 1, a numeral 41 indicates a top ring.

Figure 2:
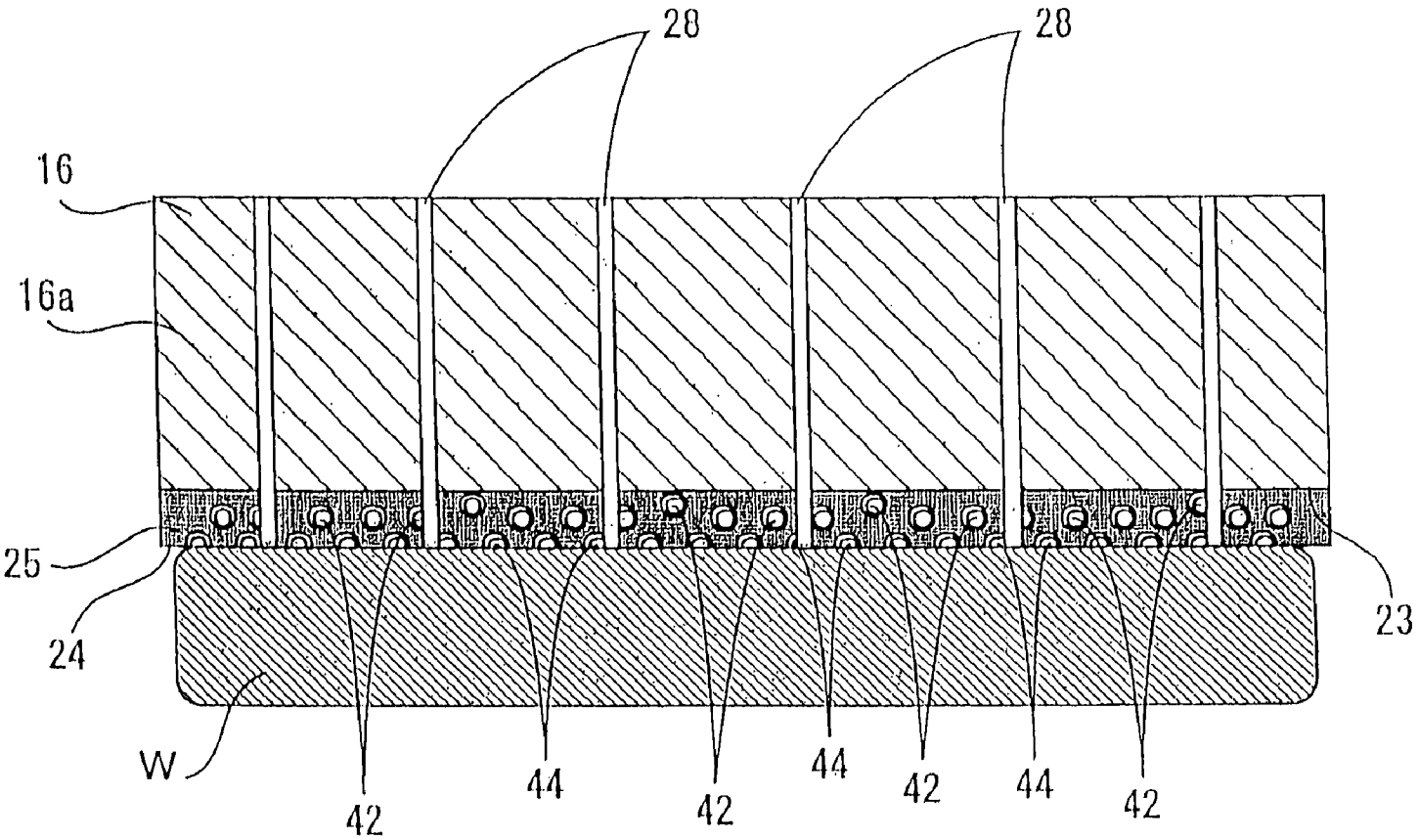
FIG. 2 is a schematic cross-sectional view illustrating a main part of the workpiece holder shown in FIG. 1.

As shown in FIG. 2, the workpiece holder 16 of the present invention is constituted of coating the surface 23 of the workpiece holder body 16*a* with a resin layer 25 which is a coating agent layer such as epoxy resin, and can be formed by adding particles 42 (or hollow particles) dissoluble in a dissolving agent such as water or a solvent to the coating agent layer (resin layer).

Particles 42 are made of solid materials which are particles dissoluble in water, a solvent or the like, or hollow particles having sizes of about 3-300 μm.

EDTA or the like can be given as a material of dissoluble particles.

Water-soluble cellulose particles or the like can also be used as dissoluble particles.

The particles 42 on the surface of this coating agent layer, i.e., the resin layer 25 are dissolved by a dissolving agent such as water or a solvent to form pores 44 on the surface of the resin layer 25, i.e., on the workpiece holding surface 24 of the workpiece holder 16.

Figure 3:
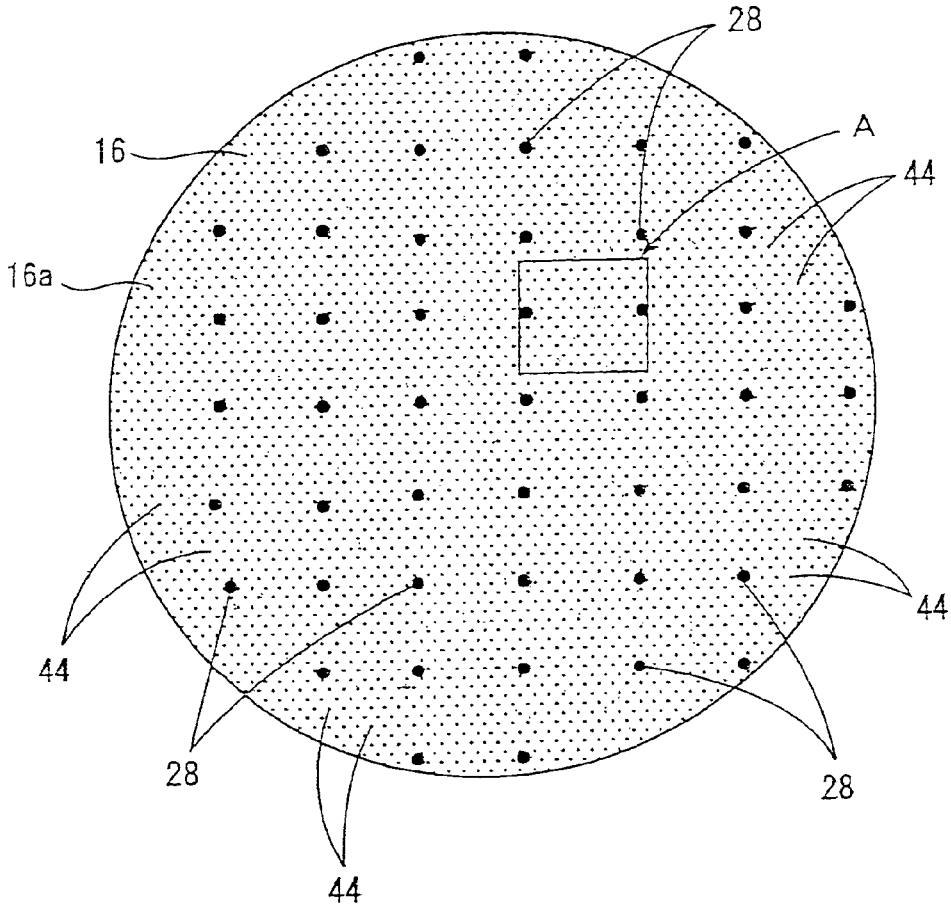
FIG. 3 is an explanatory view showing the workpiece holding surface of the workpiece holder shown in FIG. 2.
Figure 4:
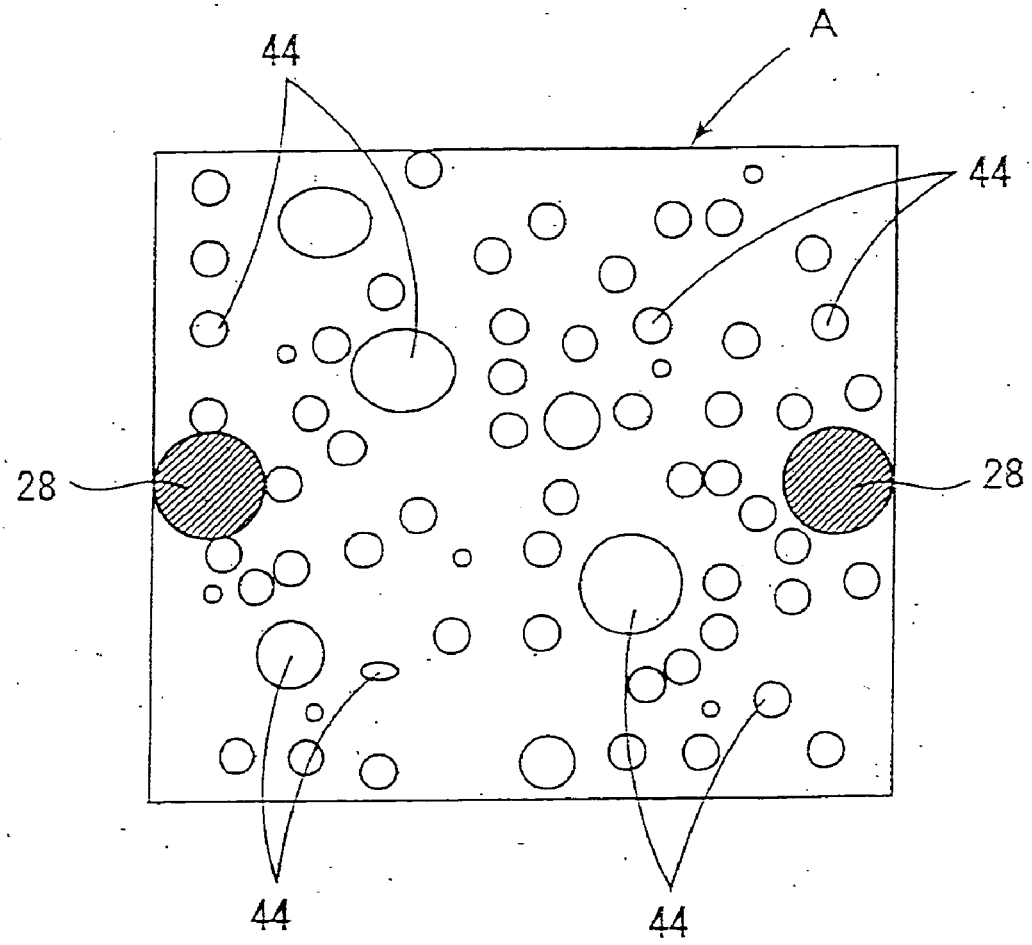
FIG. 4 is an enlarged view of the A part shown in FIG. 3.

In addition, FIG. 3 shows an overall view of the workpiece holding surface 24 of the workpiece holder 16, and FIG. 4 shows an enlarged schematic view of a part of FIG. 3.

On the other hand, as to the hollow particles used in a method of forming pores wherein the coating agent layer is polished after hollow particles or the like possible to form pores on the workpiece holding surface by polishing are added to the coating agent layer, hollow particles having thin shells can be used, and in particular, silica balloons having diameters of about 2-300 μm are preferred.

By polishing the coating agent layer, for example, the resin layer 25, including hollow particles 42, pores 44 can be formed in the surface of the resin layer 25, i.e., the workpiece holding surface 24 of the workpiece holder 16 (FIGS. 3 and 4).

It is preferable that diameters of the pores 44 described above are 0.5 mm or less.

This is because there is a possibility that shapes of the pores are transferred to a wafer surface when diameters of the pores are more than 0.5 mm.

Also, as described above, in the case that particles dissoluble in a dissolving agent, or the like, are used to form pores, pores having various diameters from several micrometers to several hundred micrometers are formed.

Therefore, the lower limit of the diameters of the pores is not specifically limited, but if there are only too small pores, there may be the case that when a wafer is held by suction, water or air can not escape and remain between the wafer and the workpiece holder, air traps or water lies between the wafer and the workpiece holder, and micro dimples are occurred, so that its nanotopography is degraded. Therefore, the workpiece holder in which many pores having diameters of 0.02 mm are formed is preferred.

In particular, it is preferable that average diameters of pores when they are evaluated in a certain area are several dozen micrometers or more, for example, 50-150 μm.

Figure 8:
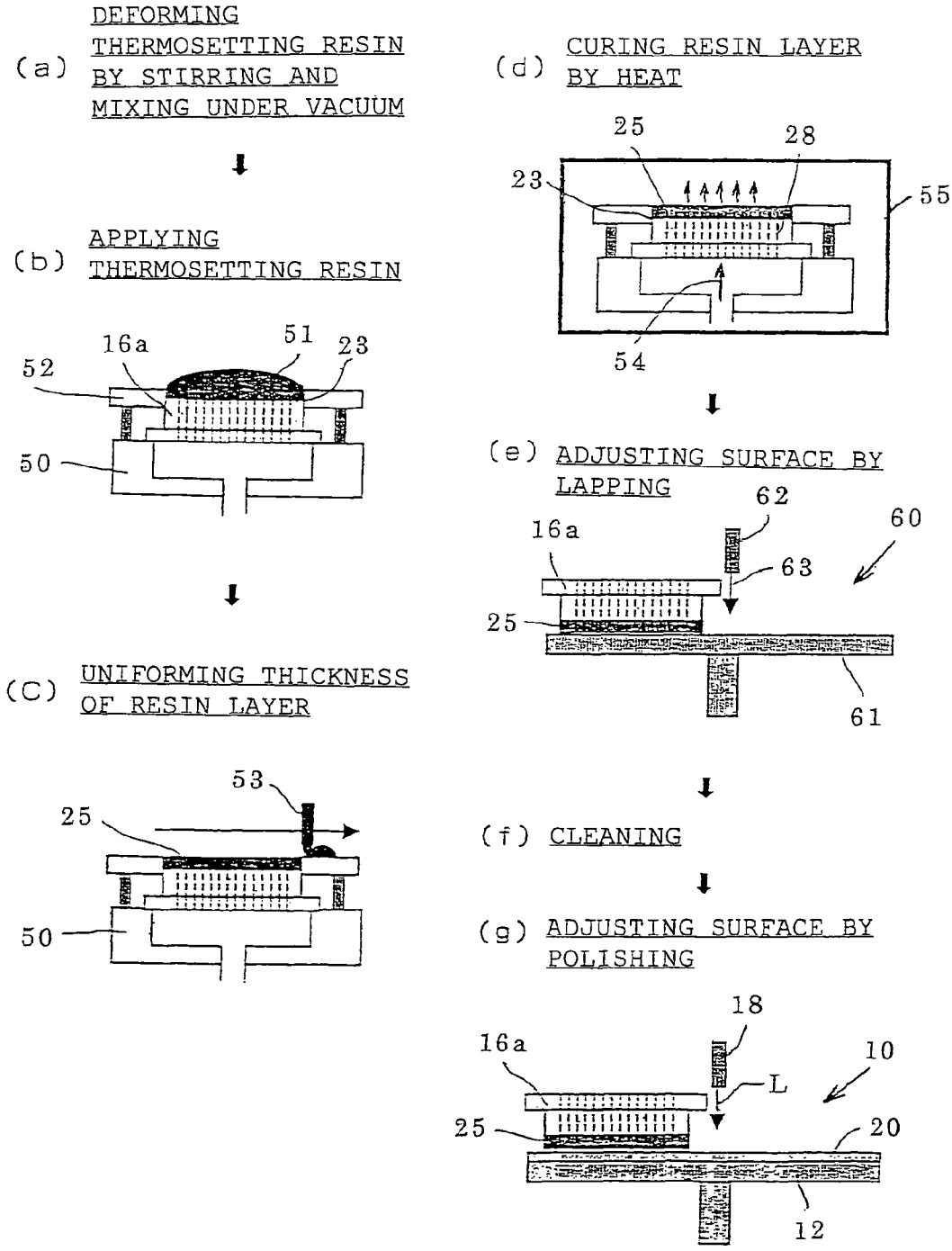
FIG. 8 is a flowchart comprised of steps (a)-(g) showing a production process of the workpiece holder for polishing of the present invention.

One example of a production method of the workpiece holder of the present invention will be explained with a flowchart shown in FIG. 8.

First, in the step (a), a thermosetting resin and particles dissoluble in water or a solvent (or hollow particles) are put into a stirring and mixing tank, and defoaming is sufficiently performed under vacuum to eliminate air.

In the step (b), after the workpiece holder body 16*a* of the workpiece holder 16 is placed on a jig 50 for applying resin with the surface 23 of the workpiece holder body 16*a* up and a plate 52 for adjusting application volume is set, the thermosetting resin 51 is poured onto the surface 23 of the workpiece holder body 16*a*.

In the step (c), a bar 53 is slid on the plate 52 for adjusting application volume to scrape excess resin 51, so that a resin layer having a uniform thickness is formed.

Next, in the step (d), the workpiece holder body 16*a* to which the resin is applied and the jig 50 for applying resin are placed in an electric heating furnace 55, and heating is started by flowing heated gas 54 from the lower part of the jig 50 for applying resin through perforated holes 28 of the workpiece holder body 16*a*, so that the entire resin layer 25 is cured by heat.

In this case, after resin on a periphery of the perforated holes 28 is pre-cured, the other part of the resin can be cured by heat, and since the resin on a periphery of the perforated holes 28 is firstly pre-cured, blockage of the perforated holes can be further surely prevented.

It is possible to set the temperature of gas for heat curing at the same temperature as the curing temperature of resin, or higher temperature than it. If the temperature of gas is the same as the curing temperature of resin, the reaction rate of heat curing is slower than the rate of decreasing viscosity of the resin due to heating, and therefore, it is preferable that the resin layer 25 can be formed without blockage of the perforated holes 28.

As performed in this manner, the workpiece holder body 16*a* where particles dissoluble in water or a solvent or hollow particles are added to the resin layer 25 formed on the surface 23 of the workpiece holder body 16*a* can be produced.

Next, in the step (e), the workpiece holder body 16*a* of which surface is coated with the resin layer 25 is set on a lapping machine 60, lapping solution 63 is dropped from a nozzle while rotating a turntable 61, the surface of the resin layer 25 is ground to adjust the surface, and the workpiece holder body 16*a* is cleaned in the step (f).

Moreover, in the step (g), the workpiece holder body 16*a* of which surface is coated with the resin layer 25 subjected to lapping adjustment is set on a polishing apparatus 10, polishing agent L is dropped from a nozzle 18 while rotating a turntable 12, the surface of the resin layer 25 is polished to adjust the surface, the workpiece holder body 16*a* is sufficiently cleaned to complete it, and a workpiece holder back plate 30 is attached to the workpiece holder body 16*a* to produce a polishing head 14.

As performed in this manner, the workpiece holder 16 where micro pores 44 are formed on the workpiece holding surface 24 of the workpiece holder body 16*a* can be obtained (FIGS. 3 and 4).

Next, there will be explained the case that the technical ideas of the present invention are applied to a wax-free polishing type apparatus in reference to examples shown in FIGS. 5 and 6.

Figure 5:
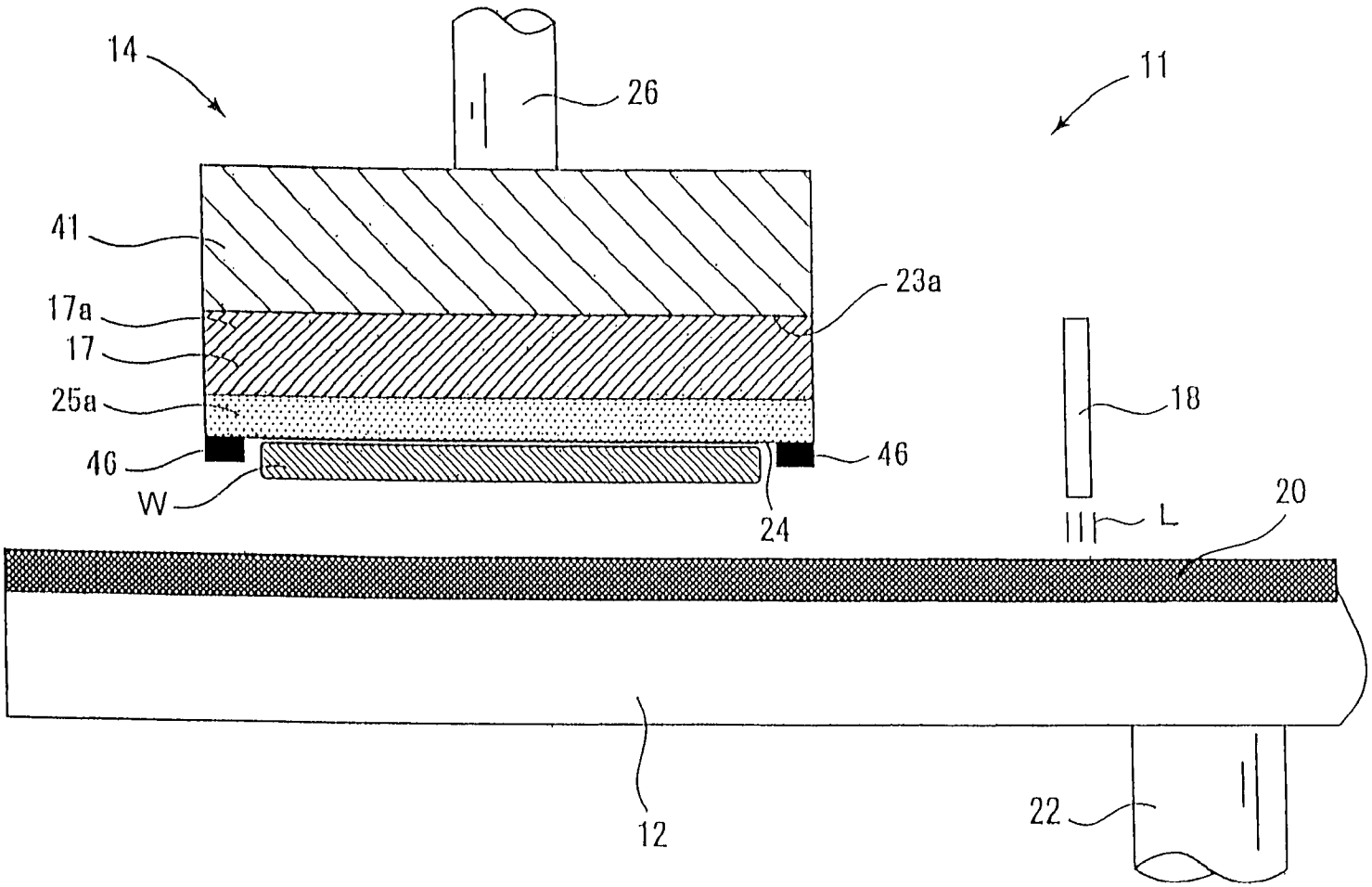
FIG. 5 is a schematic cross-sectional view illustrating another embodiment of a polishing apparatus according to the present invention.

In FIG. 5, a numeral 17 indicates a workpiece holder comprising a workpiece holder body 17*a* of which back surface is attached to a top ring 41 and a resin film 25*a* which is adhered to a surface 23*a* of the workpiece holder body 17*a* by double-faced adhesive tape or adhesive.

Figure 6:
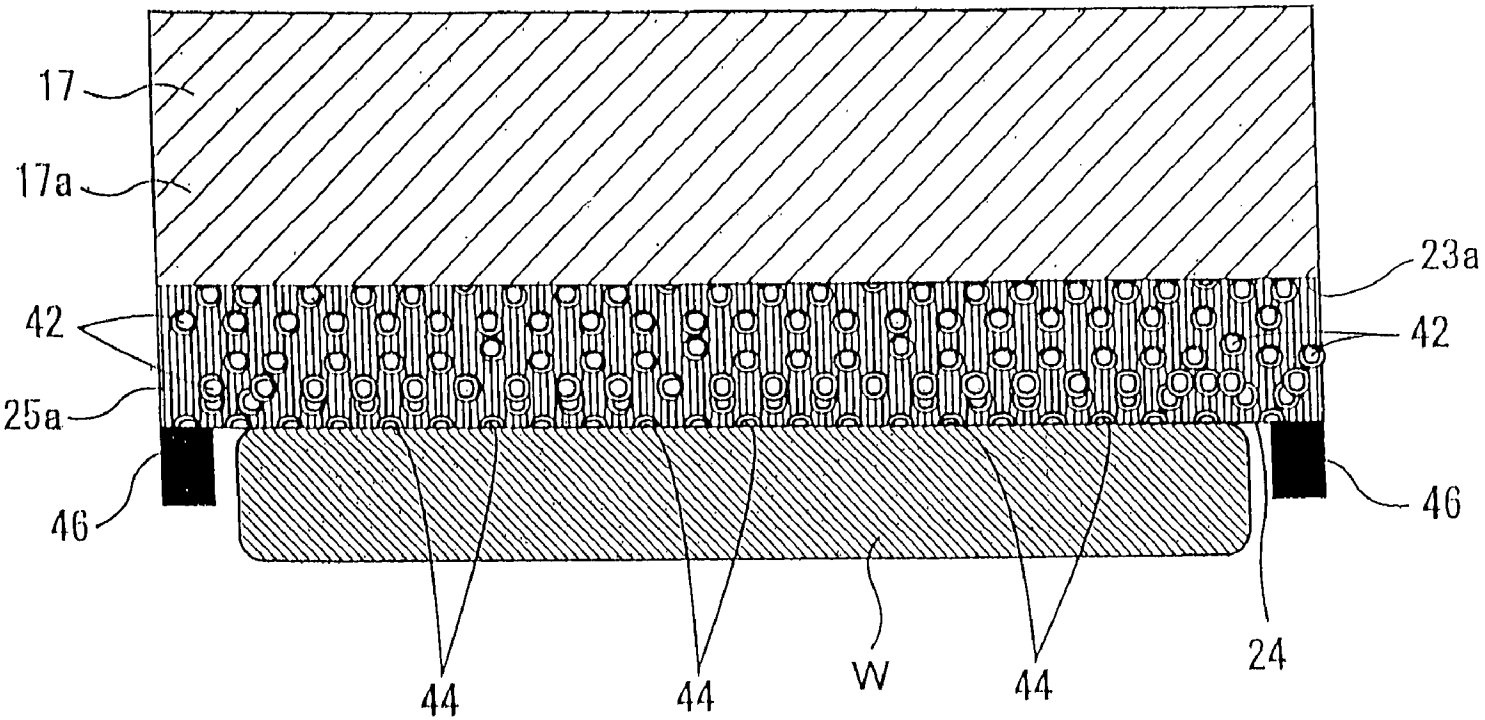
FIG. 6 is a schematic cross-sectional view illustrating a main part of the workpiece holder shown in FIG. 5.

As shown in FIG. 6, in the case of forming the resin film 25*a*, particles dissoluble in a dissolving agent such as a solvent or water are added to raw resin to form a resin block, the resin block is sliced into a thin film, a surface of the thin film is ground by machining to flatten it, the resin film 25*a* is adhered to the workpiece holder body 17*a* by double-faced adhesive tape or adhesive, the surface of the resin film 25*a* is treated with dissolving agent such as water or a solvent, and thereby, pores 44 can be formed only on the surface of the resin film 25*a*, and the surface on which the pores 44 are formed can be used as the workpiece holding surface 24.

In FIGS. 5 and 6, a numeral 46 indicates a template provided to prevent a fall of a wafer during polishing.

Since the other components are the same as FIG. 1, repetition of the explanation will be omitted.

In addition, examples of FIGS. 5 and 6, which are different from those of FIGS. 1 and 2, show the case that the perforated holes 28 are not provided with the workpiece holder body 17*a*. However, it is surely possible to employ the feature that the perforated holes 28 are formed in the workpiece holder body 17*a* and hold a workpiece W on the workpiece holding surface 24 by suction.

Hereinafter, another aspect of the present invention will be further explained in detail. However, the present is not limited thereto.

Inventors of the present invention assiduously investigated the cause of degradation of nanotopography in a workpiece polishing process, and found another cause that heat was accumulated in resin coating a workpiece holding surface, so that the holding surface was deformed. And it was found that this phenomenon remarkably occurred near suction holes, in particular.

Figure 7:
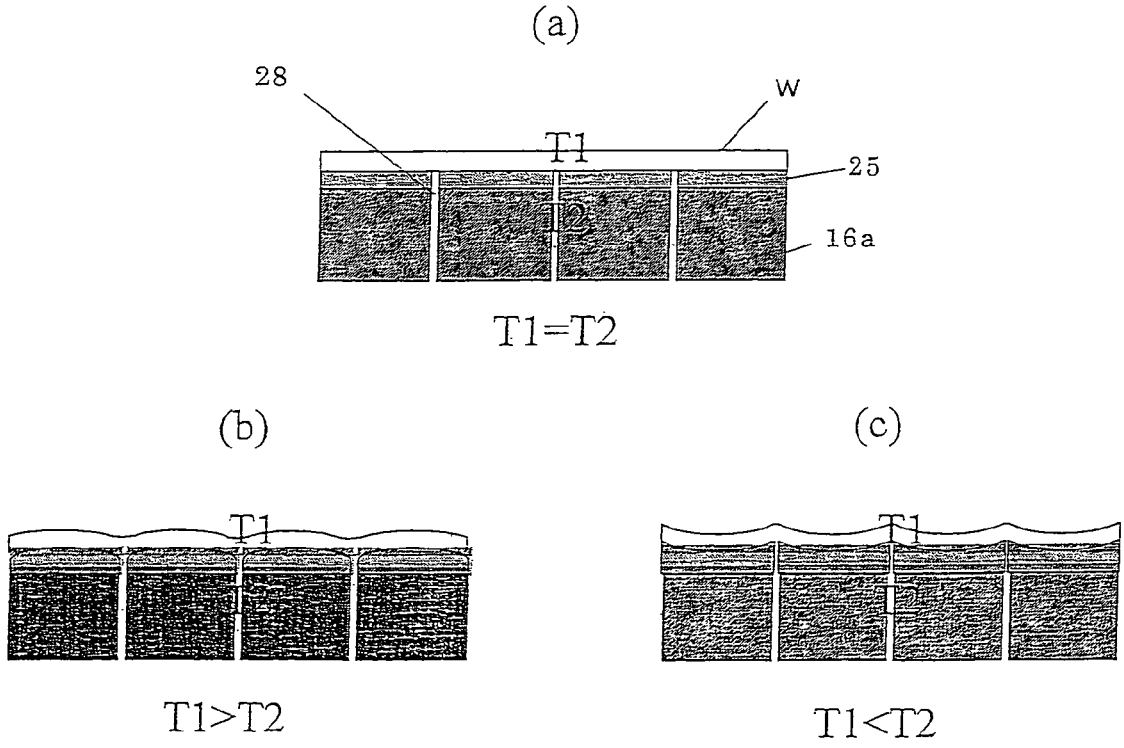
FIGS. 7(*a*)-(*c*) are schematic explanatory views regarding deformation of a resin layer.

In the workpiece holder for polishing as shown in FIG. 7(*a*), for example, as to a resin layer 25 made of epoxy resin, it became clear that the temperature difference occurs between temperature T1 of a side to hold a wafer and temperature T2 of a contact side with a workpiece holder body 16*a* made of ceramics such as SiC, and thus, the epoxy resin of the resin layer 25 is deformed. And it was also found that this deformation affects unevenness on a nanotopography level.

For example, as shown in FIG. 7(*b*), in the case of T1>T2, when a wafer is held by vacuum suction, parts near suction holes become concave shapes, and as shown in FIG. 7(*c*), in the case of T1<T2, when a wafer is held by vacuum suction, parts near suction holes become convex shapes. Therefore, if a wafer held by suction is polished in these states, in the case of T1>T2, since a wafer is held in a state that parts near suction holes are concave shapes, the parts near suction holes are insufficiently polished, and thus, parts of the wafer held near suction holes become raised after the polishing (FIG. 7(*b*)). On the contrary, in the case of T1<T2, since a wafer is held in a state that parts near suction holes are convex shapes, the parts near suction holes are excessively polished, and thus, parts of the wafer held near suction holes become concave shapes (FIG. 7(*c*)).

It is considered that since such deformation of the resin layer occurs, waviness is made near suction holes and degradation of nanotopography occurs.

In order to prevent such degradation of nanotopography, it is necessary to prevent thermal deformation of resin coating a workpiece holding surface. For that purpose, it is necessary to give attention to thermal properties of resin, in particular, a coefficient of thermal expansion and thermal conductivity. This is because if a coefficient of thermal expansion is small, deformation is difficult to occur even when the temperature difference between front and back surfaces of the resin layer is large, and if thermal conductivity is large, heat generating during polishing is easy to be uniform in the resin and heat can be efficiently radiated to the outside, and therefore, thermal deformation is further difficult to occur.

Consequently, inventors of the present invention assiduously investigated a coefficient of thermal expansion and thermal conductivity of a workpiece holder for polishing, and found that such thermal deformation was extremely decreased when a coefficient of thermal expansion was $3\times10^{-5}$/K or less and thermal conductivity was 0.4 W/mK or more. However, a coefficient of thermal expansion of conventional resin coating a workpiece holder was about $5\times10^{-5}$/K and its thermal conductivity was about 0.2-0.3 W/mK. In order to prevent thermal deformation, it is necessary to set a coefficient of thermal expansion of resin at $3\times10^{-5}$/K or less and thermal conductivity of resin at 0.4 W/mK or more in some way.

Accordingly, inventors of the present invention conceived the use of resin filled with silica particles as fillers instead of resin filled with calcium carbonate particles. Calcium carbonate particles are filled into epoxy resin only at about 50% by weight. However, since silica particles can be filled into epoxy resin at 60% by weight or more and the coefficient of thermal expansion of silica is small, both the coefficient of thermal expansion and the thermal conductivity of the resin coating the workpiece holder body can be surely set within the above ranges.

Based on the above ideas, the present invention was accomplished through close investigations of the conditions.

Hereinafter, there will be explained one example of a production method of a workpiece holder used in the aspect of the present invention according to the flowchart shown in FIG. 8 as aforementioned.

First, in the step (a), a thermosetting resin such as epoxy resin and adjusters of thermal conductivity such as silica particles are put into a stirring and mixing tank, and defoaming is sufficiently performed under vacuum to eliminate air. At this point, in the case that epoxy resin includes silica particles, in order to surely set the coefficient of thermal expansion and the thermal conductivity of the epoxy resin at $3\times10^{-5}$/K or less and 0.4 W/mK or more, respectively, it is preferable that silica particles are filled into the epoxy resin at 60% by weight or more.

In order to accomplish this, it is preferable that silica particles filled into the epoxy resin are granulated particles having diameters of 1-10 μm. This is because, in the case of small silica particles of less than 1 μm, the viscosity of the resin into which silica particles are filled is increased, and many silica particles are not filled into the resin. Also, in the case of large silica particles having diameters of more than 10 μm, unevenness of the surface of the resin coating the holding surface is increased, and if a wafer is held on the surface thereof, there is a possibility that its nanotopography is degraded. Further, in this case, almost spherical large silica particles having diameters of about 10 μm and almost spherical small silica particles having diameters of about 1-3 μm are filled into the resin, and thereby, it is possible that the amount of the filled particles is further increased, the coefficient of thermal expansion can be further decreased and the thermal conductivity can be further increased.

Step (b) is performed as in the aforementioned aspect. In addition, as to properties which the workpiece holder body 16*a* to be coated with resin should have, it is preferable that diameters of perforated holes 28 are 0.2-0.5 mm, it is desirable that the coefficient of thermal expansion of the workpiece holder body 16*a* is $1\times10^{-5}$/K or less, which is smaller than the coefficient of linear thermal expansion of the workpiece holder body 16*a*, and moreover, it is preferable that a material of the workpiece holder body 16*a* is a sintered compact (ceramics) of silicon carbide (SiC). As described above, if diameters of the perforated holes 28 are 0.2 mm or more, there is no possibility that the holes are not blocked by a thermosetting resin 51 when a resin layer 25 is formed on a holding surface 24 of the holder body 16*a* by the thermosetting resin 51, and diameters of the perforated holes 28 is 0.5 mm or less, there is little possibility to transfer prints of the holes to a workpiece surface during a workpiece polishing process since diameters of the holes are too large.

Also, if the workpiece holder body 16*a* is produced from a material having low coefficient of thermal expansion, the difference of the quantity of the thermal deformation of the workpiece holder body 16*a* can be small in the cases as described below that the holding surface of the workpiece holder is subjected to polishing on a turntable of a polishing apparatus and that a workpiece is subjected to polishing, deformation of a coating resin or the like can be prevented, and thereby, it is possible that the shape of the holding surface of the workpiece holder is maintained with high precision and a workpiece polishing process with high flatness can be performed. It is advisable that the workpiece holder body is constituted of metal, ceramics material or the like, and in particular, silicon carbide (SiC) as aforementioned is preferably used as a material having a low coefficient of thermal expansion, high stiffness, and high corrosion resistance, that is, difficult to be corroded even by a polishing agent or the like.

In the step (c), a bar 53 is slid on the plate 52 for adjusting application volume to scrape excess resin 51, so that a resin layer having a uniform thickness is formed. It is desirable that the thickness of the resin layer 25 coating the holding surface of the workpiece holder 16*a* is 0.5-3 mm. As described above, if the thickness of the resin layer 25 of the workpiece holder 16 is 3 mm or less, stiffness of the workpiece holder body 16*a* is not degraded, and therefore, a workpiece polishing process can be performed with further high precision, and if the thickness of the resin layer 25 is 0.5 mm or more, high flatness can be obtained.

Next, steps (d)-(e) are performed as in the aforementioned aspect. Moreover, in step (g), the workpiece holder body 16*a* of which surface is coated with the resin layer 25 subjected to lapping adjustment is set on a polishing apparatus 10, polishing agent L is dropped from a nozzle while rotating a turntable 12, the surface of the resin layer 25 is polished to adjust the surface, the workpiece holder body 16*a* is sufficiently cleaned to complete it, and a workpiece holder back plate 30 is attached to the workpiece holder body 16*a* to produce a polishing head 14. As described above, the surface of the resin layer 25, which is cured by heat, is firstly subjected to lapping to adjust the surface and next subjected to polishing for adjustment on a turntable of the polishing apparatus 10, thereby, the shape of the holding surface of the holder 16 can be formed with further high precision, and by using this workpiece holder 16 for polishing, a workpiece polishing process can be performed with further high precision.

As performed in this manner, a workpiece holder wherein many silica particles are added to a part made of the epoxy resin of the workpiece holding portion as thermal conductivity adjusters can be produced. By properly adding silica particles thereto as thermal conductivity adjusters, a workpiece holder in which thermal conductivity of the resin on the surface of the workpiece holder is 0.4 W/mK or more and a coefficient of thermal expansion is $3\times10^{-5}$/K or less can be surely obtained.

Such a workpiece holder is mounted on the polishing apparatus as shown in FIG. 1 to polish a workpiece W as aforementioned. In the present invention, since the workpiece holder 16 for polishing is difficult to be thermally deformed during polishing, the nanotopography of the workpiece W after polishing, which was a conventional problem, can be improved.

In this case, a polishing pad 20 is deformed with indicating viscoelastic property, and the degree of such deformation gradually varies according to the condition of the polishing pad 20 during polishing. Therefore, even if the workpiece holding surface 24 of the workpiece holder 16 is finished to be flattened as described above, there may be a case that a workpiece W is not flattened even after the processing. Accordingly, before a back surface of the workpiece W is held by vacuum suction, the holding surface 24 coated with resin of the workpiece holder 16 for polishing is brought into close contact with the polishing pad 20 to polish the holding surface 24 so that the shape of the holding surface 24 is made to fit to that of the polishing pad 20, after that, the back surface of the workpiece W is held on this holding surface 24 by vacuum suction and a front surface of the workpiece W is brought into close contact with the polishing pad 20 to polish the front surface, and thereby, the holding surface 24 can be adjusted and the flatness of the workpiece W can be improved. This method is particularly effective in the case that a thin workpiece such as a wafer is polished.

Hereinafter, the present invention will be explained specifically in reference to the examples and comparative examples below, but the present invention is not limited thereto.

EXAMPLE 1

One example of a method of producing a workpiece holder of the present invention will be explained.

First, a thermosetting epoxy resin serving as a thermosetting resin and EDTA particles serving as particles dissoluble in water or a solvent having diameters of about 3-300 μm at 20% by weight against the epoxy resin were put into a stirring and mixing tank, and defoaming was sufficiently performed under vacuum to eliminate air.

A workpiece holder body constituted of a silicon carbide (SiC) perforated plate having a thickness of 30 mm (diameters of holes are 0.4 mm and the coefficient of thermal expansion is $4\times10^{-6}$/° C.) was placed on a jig for applying resin with the workpiece holding surface up, a plate for adjusting application volume was set, and after that, the thermosetting resin was poured onto the workpiece holding surface.

A bar was slid on the plate for adjusting application volume to scrape excess resin, so that a resin layer having a thickness of about 1 mm was formed.

Next, the workpiece holder body to which the resin was applied and the jig for applying resin were placed in an electric heating furnace, and heating was started by flowing heated gas from the lower part of the jig for applying resin through perforated holes of the workpiece holder body, so that the entire resin layer was cured by heat.

Next, the workpiece holder body coated with the resin layer was set on a lapping machine, lapping solution was dropped from a nozzle while rotating a turntable, the surface of the resin layer is ground to adjust the surface, and the workpiece holder body is sufficiently cleaned.

Moreover, the workpiece holder body coated with the resin layer subjected to lapping adjustment was set on a polishing apparatus, polishing agent was dropped from a nozzle while rotating the turntable, a surface of the resin layer was polished to adjust the surface (the resin layer was polished about 40 μm), the workpiece holder body was sufficiently cleaned to complete it, and a workpiece holder back plate was attached to the workpiece holder body to produce a polishing head.

As performed in that manner, EDTA particles were dissolved during lapping and polishing, and a workpiece holder that micro pores were formed on the surface thereof was obtained.

Pores therein had diameters of from several micrometers to several hundred micrometers, and almost all of them had diameters of 20 μm (0.02 mm) or more and 500 μm (0.5 mm) or less.

In the example, an average diameter of pores (referred as average pore diameter) evaluated in an area of 1 $cm^2$ in the center of the workpiece holder was about 150 μm.

EXAMPLE 2

A polishing head was constituted by setting such a workpiece holder on a polishing apparatus as shown in FIG. 1.

A silicon wafer (diameter was 200 mm and thickness was 735 μm) as a workpiece was polished.

As to workpiece polishing conditions, polishing was performed under conditions that the polishing load was 30 kPa, the relative rate of polishing was 50 m/min, and the target stock removal of polishing was 10 μm.

A non-woven type polishing pad was used as a polishing pad, and alkaline solution (pH 10.5) containing colloidal silica was used as polishing agent.

Flatness of the workpiece, waviness, and nanotopography after polishing were measured.

The flatness was measured by a capacitance type thickness meter (Ultra Gage 9700 made by ADE Corporation) under the condition that 2 mm from a periphery of the workpiece was excluded, and waviness of the workpiece surface was observed by a magic mirror.

The nanotopography was measured by NanoMapper made by ADE Corporation under the condition that the measurement was performed in 2 mm square.

As the result, as to the flatness of the workpiece, high flatness of 0.15 μm in SBIRmax (Site Back-side Ideal Range: the value standardized by M1 of SEMI (Semiconductor Equipment and Materials International) standards or the like, and its cell size is 25×25) of back side reference was accomplished.

Also, no waviness could be observed on the workpiece surface by a magic mirror, i.e., high precision processing was accomplished.

Further, the nanotopography was a good value of 10 nm.

COMPARATIVE EXAMPLE 1

A workpiece holder was formed as in Example 1 without adding EDTA particles to the epoxy resin layer of the workpiece holder, and after that, the polishing was performed as in Example 2.

As the result, as to the flatness of the workpiece, high flatness of 0.15 μm in SBIRmax of back side reference was accomplished and no waviness could be observed on the workpiece surface by a magic mirror, i.e., high precision processing was accomplished.

However, since many micro dimples considered to be caused by air traps were generated, the value of the nanotopography was about 30 nm.

EXAMPLE 3

Hollow silica particles having diameters of about 15 μm were filled into the epoxy resin at 20% by weight, and a workpiece holder was produced as in Example 1.

As the result, a workpiece holder of which average pore diameter was about 20 μm was obtained.

By using that workpiece holder, a wafer was polished as in Example 2, and the flatness of the wafer was measured.

As the result, SBIRmax was 0.14 μm.

The nanotopography level was a good value of 18 nm.

COMPARATIVE EXAMPLE 2

Air bubbles were introduced into the epoxy resin by pressure kneading, and a workpiece holder was formed as in Example 1.

As the result, a workpiece holder of which average pore diameter was 600 μm was obtained.

By using that workpiece holder, a wafer was polished as in Example 2, and the flatness of the wafer was measured.

As the result, SBIRmax was 0.16 μm.

Since protrusions were generated in the parts which seem to correspond to the parts where large pores were formed, the nanotopography level was degraded at 50 nm.

EXAMPLE 4

A workpiece was polished using a workpiece polishing apparatus 10 having a structure shown in FIG. 1. A resin layer 25 coating a holding surface 24 of a workpiece holding body 16*a* was made of epoxy resin into which silica particles was filled at 70% by weight. As to the resin layer 25, the thickness was 1 mm, the thermal conductivity was 0.5 W/mK, and the coefficient of thermal expansion was $1\times10^{-5}$/K.

A workpiece holder body 16*a* was constituted of a silicon carbide (SiC) perforated plate having a thickness of 30 mm, and its coefficient of thermal expansion was $4\times10^{-6}$/K. The workpiece holder body 16*a* of which diameters of perforated holes 28 was 0.3 mm was used.

As to workpiece polishing conditions, polishing was performed under conditions that the polishing load was 30 kPa, the relative rate of polishing was 50 m/min, and the target stock removal of polishing was 10 μm, and a non-woven type polishing pad was used as a polishing pad 20 and alkaline solution (pH: 10.5) containing colloidal silica was used as polishing agent L.

Also, before a workpiece W was held by vacuum suction and polished, the holding surface 24 coated with the resin layer 25 of the workpiece 16 was brought into close contact with the polishing pad 20 and polished. As to polishing conditions, polishing was performed as in the above workpiece polishing conditions except the stock removal of polishing of the resin layer of 40 μm.

A silicon wafer having a diameter of 200 mm and thickness of 735 μm serving as a workpiece W to be polished was held on the workpiece holder 16 by vacuum suction and polished.

The flatness, waviness and nanotopography of the workpiece after polishing were measured. The flatness was measured by a capacitance type thickness meter (Ultra Gage 9700 made by ADE Corporation), and the waviness of the workpiece surface was observed by a magic mirror. The nanotopography was measured by NanoMapper made by ADE Corporation under the condition that the measurement was performed in 2-mm square.

As the result, as to the flatness of the workpiece, high flatness of 0.13 μm in SBIRmax (Site Back-side Ideal Range: the value standardized by M1 of SEMI (Semiconductor Equipment and Materials International) standards or the like, and its cell size is 25 mm×25 mm) of back side reference was accomplished. Also, no waviness could be observed on the workpiece surface by a magic mirror, i.e., high precision processing was accomplished. Further, the nanotopography was a good value of approximately 10 nm.

EXAMPLE 5

A workpiece holder 16 was produced under the same conditions as Example 4 except that the filling amount of silica particles in epoxy resin coating the holding surface 24 of the workpiece holder body 16*a* was 60% by weight, and the workpiece was polished under the same conditions as Example 4. Thermal conductivity of the epoxy resin filled with silica particles in the resin layer 25 was 0.4 W/mK. And its coefficient of thermal expansion was $3\times10^{-5}$/K.

As the result, flatness was almost the same as Example 4, and the nanotopography was slightly degraded, but a good value of approximately 15 nm, i.e., all of them were 20 nm or less.

COMPARATIVE EXAMPLE 3

A workpiece holder 16 was produced under the same conditions as Example 4 except that a holding surface 24 of a workpiece holder body 16*a* was coated with epoxy resin filled with calcium carbonate particles, and a workpiece was polished under the same conditions as Example 4. Thermal conductivity of the epoxy resin filled with calcium carbonate particles was 0.3 W/mK. And its coefficient of thermal expansion was $4\times10^{-5}$/K.

As the result, flatness was almost the same as Example 4, and waviness was observed on the workpiece surface by a magic mirror. The nanotopography value was approximately 30 nm, i.e., all of them were over 20 nm.

The present invention is not limited to the embodiment described above.

The above-described aspects are mere examples, and those having substantially the same structure as technical ideas described in the appended claims and providing the similar functions and advantages are included in the scope of the present invention.

For example, in the Examples, dissoluble particles are added to epoxy resin to form pores on a workpiece holding surface, and it is also possible to add particles dissoluble in water and a solvent to a resin film made of urethane or the like. In the case of using a resin film such as urethane, although pores can be formed by foaming agent, it is preferable that pores are formed by adding particles of which diameters are predetermined to the resin and dissolving or polishing them as in the present invention since size, depth, and distribution on the resin surface, etc. of pores can be arbitrarily formed.

Further, for example, the above embodiment was explained with examples in the case that epoxy resin is used as resin to coat a holding surface, and silica particles serving as thermal conductivity adjusters are filled into the resin. However, the present invention is not limited thereto, and if resin coating the holding surface has a coefficient of thermal expansion of $3\times10^{-5}$/K or less, it is included in the scope of the present invention. As an example of such resin, resin such as polyamide-imide, polyamide resin to which silica particles are added at 33% by weight or more, or the like can be given.

The invention claimed is:

1. A workpiece holder for polishing wherein the workpiece holder for polishing comprises a workpiece holder body having multiple perforated holes to hold a workpiece by vacuum suction, a holding surface of the workpiece holder body is coated with resin, a coefficient of thermal expansion of the resin coating on the holding surface is $1\times10^{-5}$/K or less, and the resin coating on the holding surface is epoxy resin filled with silica particles.

2. The workpiece holder for polishing according to claim 1 wherein thermal conductivity of the resin coating on the holding surface is 0.4 W/mK or more.

3. The workpiece holder for polishing according to claim 1 wherein the silica particles filled into the epoxy resin are 60% by weight or more of the epoxy resin.

4. The workpiece holder for polishing according to claim 1 wherein the silica particles filled into the epoxy resin are granulated particles having diameters of 1-10 μm.

5. A workpiece polishing apparatus comprising the workpiece holder for polishing according to claim 1.

6. A workpiece polishing method wherein a holding surface of a workpiece holder for polishing to hold a workpiece by vacuum suction is coated with resin of which a coefficient of thermal expansion is $1\times10^{-5}$/K or less, a back surface of the workpiece is held on the holding surface by vacuum suction, the workpiece is brought into close contact with a polishing pad to polish a front surface of the workpiece, and the resin coating on the holding surface is epoxy resin filled with silica particles.

7. The workpiece polishing method according to claim 6 wherein thermal conductivity of the resin with which the holding surface is coated is 0.4 W/mK or more.

8. The workpiece polishing method according to claim 6 wherein before the back surface of the workpiece is held by vacuum suction, the holding surface coated with the resin of the workpiece holder for polishing is brought into close contact with the polishing pad and polished, after that, the back surface of the workpiece is held on the holding surface by vacuum suction, and the workpiece is brought into close contact with the polishing pad to polish the front surface of the workpiece.

* * * * *